United States Patent [19]

Graf et al.

[11] 4,394,985

[45] Jul. 26, 1983

[54] WINDING APPARATUS FOR THREADS OR YARNS

[75] Inventors: Felix Graf, Winterthur; Armin Wirz, Ossingen, both of Switzerland

[73] Assignee: Rieter Machine Works Limited, Winterthur, Switzerland

[21] Appl. No.: 243,922

[22] PCT Filed: Jun. 26, 1980

[86] PCT No.: PCT/EP80/00037

§ 371 Date: Mar. 10, 1981

§ 102(e) Date: Mar. 2, 1981

[87] PCT Pub. No.: WO81/00248

PCT Pub. Date: Feb. 5, 1981

[30] Foreign Application Priority Data

Jul. 10, 1979 [CH] Switzerland ..... 6408/79

[51] Int. Cl.[3] ..... B65H 54/42

[52] U.S. Cl. ..... 242/18 DD

[58] Field of Search ..... 242/18 DD, 18 R, 65

[56] References Cited

U.S. PATENT DOCUMENTS

| | | | |
|---|---|---|---|
| 3,054,567 | 9/1962 | Trost | 242/18 DD |
| 3,333,780 | 8/1967 | Crouzet | 242/18 R |
| 3,593,932 | 7/1971 | Altice et al. | 242/18 DD |
| 3,970,260 | 7/1976 | Bruggisser et al. | 242/18 DD |
| 4,087,055 | 5/1978 | Yasuda et al. | 242/18 DD |

*Primary Examiner*—Stanley N. Gilreath

*Attorney, Agent, or Firm*—Werner W. Kleeman

[57] ABSTRACT

The present invention concerns an apparatus for winding threads or yarns and similar strands, in which a friction drive roll and a bobbin support roll are provided. The latter is supported only at one end, and the other end is free, in such manner that easy operation is possible. In arrangements of such type any deviation, however small, of the two rolls from their correct, parallel position, is to be avoided if correctly built bobbin packages are to be produced in the winding process. This is achieved according to the invention in that a coupling means, coupled or connected with the bobbin support roll, which moves during the winding process, brings about a forcible parallel alignment of the two rolls.

12 Claims, 4 Drawing Figures

WINDING APPARATUS FOR THREADS OR YARNS

BACKGROUND OF THE INVENTION

The present invention concerns a winding apparatus for threads or yarns with a bobbin support roll and a friction drive drum, which rolls are arranged mutually parallel and with their rotational axes contained superimposed in a substantially vertical plane, and one of which rolls being subject to the movements caused by the increase of the bobbin packages being built on the bobbin support roll, which movements are effected in guides substantially parallel to the plane, one of the rolls being pivotable in movements parallel to the plane about a pivoting axis, and the bobbin support roll being supported rotatably in a bearing located at one of its ends.

Winding of threads, yarns and similar strands on a chuck or mandrel, or onto a bobbin support roll, respectively, is a known process, the roll being supported at one side only, for operational reasons. Rotation of the bobbin support roll is effected by surface friction drive using a friction drive roll arranged parallel to the support roll and pre-tensioned with respect to it. Due mainly to the bobbin package weight increase during the winding process and due to the elastic support on the bobbin support roll, the two rolls do not remain exactly parallel during the winding process. Thus, the contacting pressure of the friction drill roll no longer is equal over the length of the bobbin support roll, such that conical bobbin packages are produced. This disadvantage is all the more considerable, the bigger and larger the bobbin packages are. If on the bobbin support roll a plurality of bobbin packages is wound simultaneously, these packages additionally differ. Thus, the production of correct bobbin packages is rendered more difficult or impossible.

From German Patent Publication No. 2,649,555 already a "self-aligning" arrangement of the friction drive roll is known. In this arrangement the latter is pivotable about an axis at right angles with respect to the rotational axis, in such manner, that owing to the pressure directed towards the bobbin support roll the friction drive roll always aligns itself parallel to the bobbin support roll. From German Patent Publication No. 2,058,513 an arrangement is known, in which the bobbin support roll aligns itself parallel to the friction drive roll. These designs incorporating a self-aligning arrangement require a complicated structure of the pivotable roll. The latter furthermore is unstable to a certain extent, which causes the excitation of vibrations, which induce wear and fractures.

On the other hand, the support roll and the friction drive roll can also be mutually aligned in such manner that they are in their mutually exactly parallel position while the bobbin packages are half built, i.e. that at the beginning of the winding process, e.g. the support roll with its free end is inclined slightly towards the friction drive roll and at the end of the winding process is slightly inclined away from it. Such machines, operating with a "mean value setting" of this type, yield better results than machines on which no measures have been taken. They perform satisfactorily only, however, for one certain bobbin package diameter to be produced. The bobbins produced still are uneven and their quality is unsatisfactory.

SUMMARY OF THE INVENTION

It thus is an important object of the present invention to eliminate the disadvantages cited. The invention is characterized in that a coupling means is provided, by means of which the movements cause rotating movements of the pivotable roll about the pivoting axis in the sense of a forcible parallelization of the rolls.

BRIEF DESCRIPTION OF THE DRAWINGS

The invention is described in more detail in the following with reference to illustrated design examples. There is shown in.

DETAILED DESCRIPTION OF THE PREFERRED EMBODIMENTS

Figure 1:
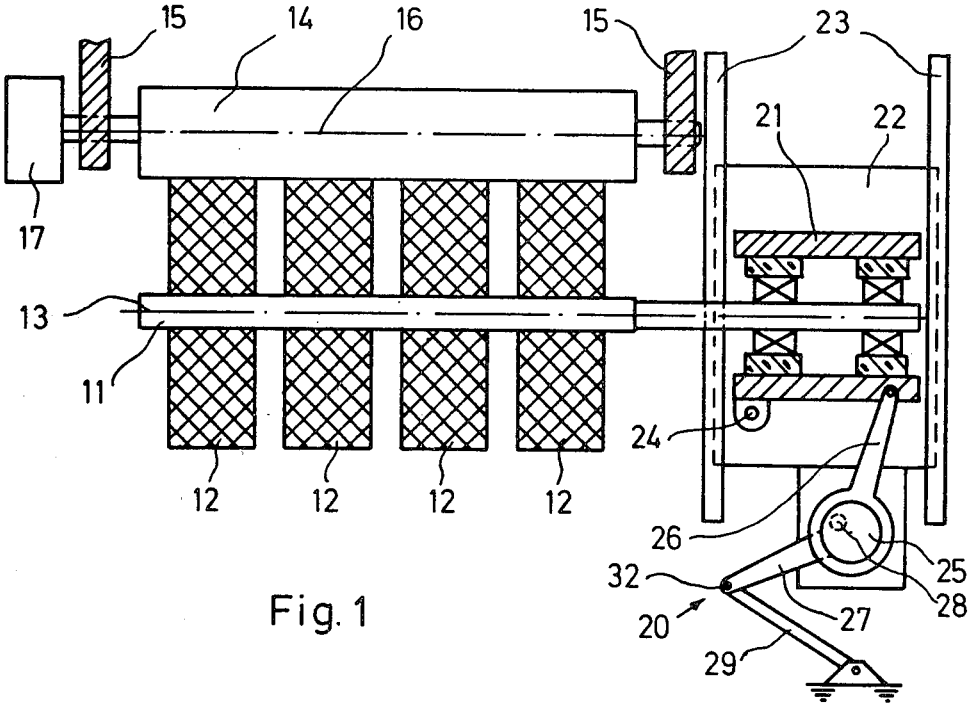
FIG. 1 a sectional side view of a bobbin support roll and a friction drive roll which, according to the present invention, are maintained in a parallel position at all times.

In FIG. 1 a bobbin support roll 11 is shown, on which four thread bobbin packages 12 have been built or are being built by winding. The roll 11 is rotatable about its rotational axis 13. Above the roll 11 a friction drive roll 14 is rigidly supported in bearings 15 and is rotatable about its rotational axis 16. The arrangement is chosen in such manner that the two axes 13 and 16 are located in a vertical plane. The roll 14 is driven by a motor 17.

The end of the bobbin support roll 11 shown at the left hand side of FIG. 1 is a free end. This end is kept free for permitting unobstructed doffing of the finished bobbin packages 12. On its right hand side the roll 11 is elastically supported in a rotation bearing 21 for avoiding vibrations. The bearing 21 is mounted on a sliding support member 22 which is movably arranged in guides 23. The guides 23 are arranged parallel to the plane defined by the axes 13, 16. Thus, the movements of the sliding support member 22 also are effected parallel to this plane. The support member 22 can be designed as sliding on the guides 23 or movable on rolls. The rotation bearing 21 is mounted on the sliding support member 22 in such manner that it is pivotable about a pivoting axis 24 supported thereon. In this arrangement the pivoting movements also are effected parallel to the plane defined by the axes 13, 16. Thus also the support roll 11 is pivotable about the pivoting axis or shaft 24 in this plane. The rotation bearing 21 furthermore is connected with an activating or actuation member 26 which is supported on a rotation element 25. The rotating or rotation element 25 also is supported by the support member 22, and it is rotatable about an eccentric axis or shaft 28 using a control element 27. The control element 27 is coupled via a pivoting or pivotal arm 29 with a fixed part of the winding apparatus. The element 25 forms the coupling point at which the control element 27 is coupled to the activating element 26.

The bobbin support roll 11 together with the rotation bearing 21 and the sliding support member or carriage 22 are pressed against the friction drive roll 14 at all times. This can be effected, e.g. if the sliding support member 22 is subject to a corresponding pressure at all times.

During the build-up of bobbin packages the motor 17 drives the roll 14. Owing to the above mentioned pressure, to which the roll 11 is subjected to at all times, the roll 11 is entrained. The increase in size of the bobbin packages 12 during the winding process causes the roll 11 to move gradually downward, while the sliding support member 22 is correspondingly moved. As the size of the bobbin packages 12 increases, also their weight increases. This causes a slight deflection of the roll 11 and a slight yielding of the bearing 21, the bearing 21 being designed as an elastic bearing. Thus the free end of the roll 11 moves downward somewhat. Even if it moves generally, only over a few millimeters at the most, the resulting deviation of the rolls 11 and 14 from their parallel position causes the bobbin packages 12 produced under such conditions to be affected by the disadvantages mentioned initially. According to the present invention, in the embodiment according to FIG. 1, a coupling means 20 is provided, which comprises the parts 25 through 28 and which forcibly achieves parallel alignment of the rolls 11 and 14. As the support roll 11 moves downward while the diameter of the bobbin packages 12 increases, also the sliding support member 22 moves downward and with it also the eccentrically supported rotating element 25. Consequently the control element 27 pivots clockwise about the axis 32 and causes an also clockwise rotation of the rotating element 25 about the axis 28. This rotation of the element 25 causes the activating member 26 to move down relative to the sliding support member 22. Thus the rotation bearing 21 is pivoted about the axis 24 also clockwise.

The setting and the eccentricity of the rotating element 25 are to be adapted to the increase in bobbin package weight in such manner that the parallel alignment is maintained during all phases of the winding process. Thus, of course, for e.g. bobbin packages of different widths or for different winding densities, different distances of the centre of the rotating element 25 from the rotational axis 28 and/or correspondingly chosen initial settings for the rotational position of the element 25 are to be chosen. Also the influence of a contact pressure upon the friction drive roll, which varies widely over the build-up of the bobbin packages, can be corrected in such manner.

Figure 2:
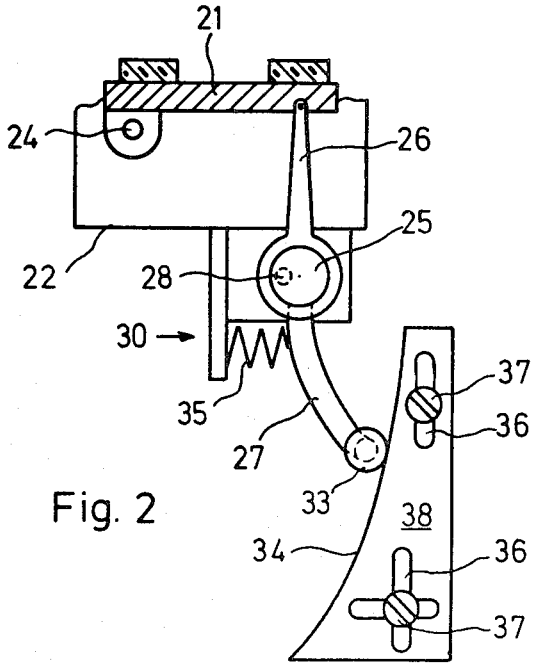
FIG. 2 a schematic view of an example of a coupling and control system.

In FIG. 2 an arrangement is shown, in which the size of the pivoting motion of the control element 27 can be pre-set in a simple manner. In FIG. 2 the lower part only of the sliding support member 22 is shown, and otherwise again the presence of the winding apparatus according to FIG. 1 is assumed. The sliding support member 22 again supports the rotation bearing 21, and at a stepped portion, the rotation element 25. The rotation element 25 in turn is supported eccentrically and rotatable about the rotational axis or shaft 28. The activating or actuation member 26 connects the element 25 with the rotation bearing 21 and causes its pivoting about the pivoting axis or shaft 24. The control element 27 is rigidly connected to the rotation element 25 and, together with it, is pivotable about the axis 28. At its free end at the control element 27 a follower roll 33 is arranged, which is provided for moving along a control cam curve or control cam 34 as the sliding support member 22 moves up or down. The control element 27 is pressed against the cam curve 34 at all times by a spring 35. The elements 25, 26, 27, 33, 34, 35 form a coupling means 30.

As the sliding support member 22 moves downward, the cam curve 34 causes pivoting of the control element 27 in the clockwise sense. Consequently also the rotating element 25 is rotated in the same sense, such that in the situation of the element 25 illustrated, the element 25 moves the activating element 26 downward with respect to the sliding support member 22. Thus the rotation bearing 21 is pivoted clockwise about the pivoting axis 24.

By using control cam curves or control cams 34 of suitable shape, any desired sequence of movements of the bobbin support roll 11 can be achieved. As indicated by slots 36 and screws 37, the position of the control cam curve 34 can be changed by movably mounting a plate 38, supporting the control cam curve 34, on a fixed part of the winding apparatus. Instead of using the depicted control cam curve 34 also an appropriately formed slot in which a sliding member fixed to the control element slides, can be provided instead of the follower roll.

It should be noted in this context, that the use of an element 25 formed as eccentric device presents the advantage that a large movement of the control element 27, in simple manner, can be transformed into a small movement of the activating member 26. This means that by using a small control force a great force can be exerted upon the roll to be pivoted, and that practically no reaction by the latter is exerted onto the control element 27.

Figure 3:
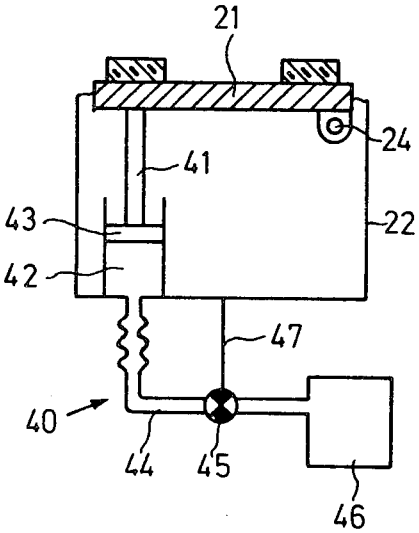
FIG. 3 a schematic view of a further example of a coupling and control system.

In FIG. 3 a further possibility of a control arrangement for the position of the support roll 11 with respect to the friction drive roll is shown. The rotation bearing 21, which again is supported on a sliding support member 22 by a pivoting axis or pivot shaft 24, is connected via an activation or actuation member 41 formed as a piston rod with a piston 43 provided in a cylinder 42. Via the duct 44 and via the control valve 45 a gaseous or liquid medium is supplied to the cylinder 42, which liquid medium is furnished from the reservoir 46. The control of the control valve 45 is effected by the control element 47.

The duct 44 is flexible such that a movement of the sliding support member 22 with respect to the control valve 45, which is fixed to the apparatus, is rendered possible. As the sliding support member 22 moves up or down, the control element 47 is moved together with the sliding support member 22 and exerts a control action onto the valve 45. This control arrangement is laid out such, that in the roll arrangement shown in FIG. 1, the pressure within cylinder 42 is increased as the sliding support member 22 moves downward. In this manner a pivoting motion of the rotation bearing 21 clockwise about the pivoting axis or pivot shaft 24 is achieved, and thus the lowering of the free end of the bobbin support roll 11 during the winding process is compensated for.

Figure 4:
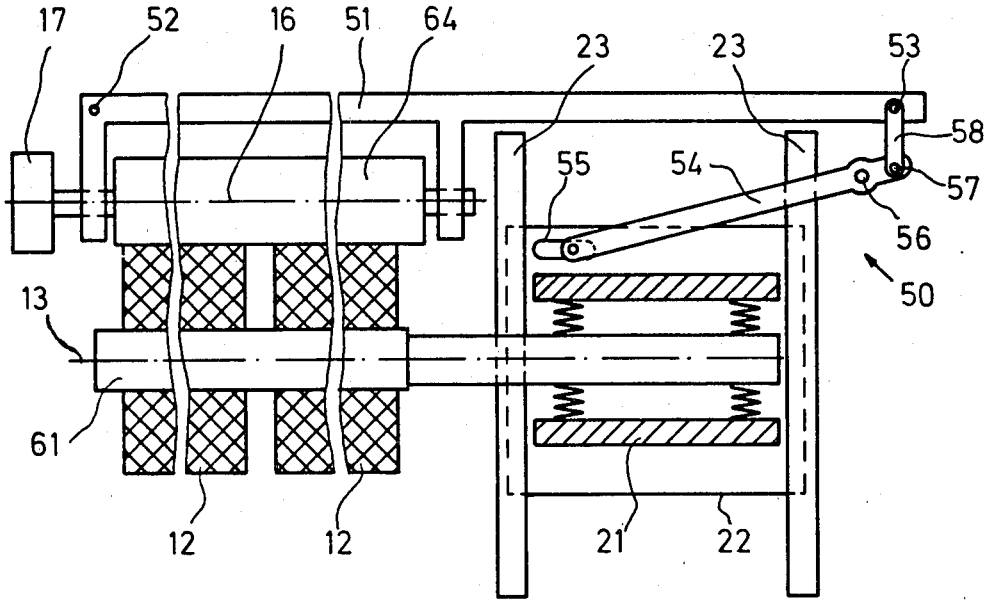
FIG. 4 a sectional side view of a further embodiment for maintaining the two rolls parallel.

A further alternative design example of a winding apparatus according to the invention is shown in FIG. 4. In this arrangement again a friction drive roll 64 is driven by a motor 17. The roll 64 and the motor 17 are rotatably mounted in a support frame 51. The frame 51 is pivotable about the pivoting axis or pivot shaft 52 and is supported thereat. At its other end, shown at the right in FIG. 4, the frame is held by a pin 53. A bobbin support roll 61 on which bobbin packages 12 are built, again is elastically supported in a rotation bearing 21. The axes 13, 16 of the rolls 61 and 64 again are arranged in a substantially vertical plane. Arranged parallel to this plane again are guides 23 formed by guide rails, in which a sliding support member 22 is movable substantially parallel to this plane.

A two-armed or double-arm lever 54 is slidably and pivotably supported with its one end in a slot 55 in the sliding support member 22. In the vicinity of its other end it is pivotable about a shaft 56 which is combined to a part fixed to the apparatus. The pin 53 and an axis or shaft 57 at the short end of the lever 54 are connected by a link designed as an activating or actuation member 58. The axis or shaft 57 can be mounted to the short lever arm in any known manner at different, selectable distances from the shaft 56. The elements 53 through 58 form a coupling means 50 and the axis or shaft 57 is the coupling point at which the control element 54 is coupled to the activating member 58.

As the diameters of the thread bobbin packages 12 increase during the winding process, the bobbin support roll 61 and the rotation bearing 21 move downward together with the sliding support member 22. Consequently the lever 54 is pivoted counter-clockwise about the shaft 56 in such manner that the axis 57 is moved upward. The activating member 58 thus lifts the pin 53 in such manner that the support frame 51 and thus the friction drive roll 64 again are brought into a position parallel to the support roll 61. The selectable, variable distances between the shaft 56 and the axis 57 are used for adaption to various thread types, and to the winding density of the bobbin package 12 chosen.

While there are shown and described present preferred embodiments of the invention, it is to be distinctly understood that the invention is not limited thereto, but may be otherwise variously embodied and practiced within the scope of the following claims. ACCORDINGLY

What we claim is:

1. A winding apparatus for threads or the like, comprising:

a bobbin support roll upon which there is formed at least one bobbin package;

a friction drive roll cooperating with said bobbin support roll;

each of said rolls having an axis of rotation;

said rolls being arranged substantially mutually parallel to one another and with their axes of rotation located in superimposed fashion in a substantially vertical plane;

one of said rolls being subjected to displacement movements caused by an increase in the size of the bobbin packages formed upon the bobbin support roll;

means for mounting and guiding said one roll to enable said one roll to carry out said displacement movements in a direction substantially parallel to said vertical plane;

means providing a pivot axis for enabling pivotal movement of one of the rolls in a direction substantially parallel to said vertical plane about said pivot axis;

said mounting means including bearing means located at one end of said roll subjected to said displacement movements for supporting said roll; and coupling means responsive to the displacement movements of said one roll for causing pivotal movements of said one pivotable roll about said pivot axis in the sense of bringing about an automatic parallelization of said rolls with respect to one another.

2. The apparatus as defined in claim 1, wherein:

said coupling means comprises:

a control element;

an actuation member operatively coupled with said control element at a predetermined coupling location;

said control element being coupled between a part fixed to the winding apparatus and said displaceable roll; and said actuation member being operatively connected between said coupling location and the pivotable roll.

3. The apparatus as defined in claim 1, wherein:

said coupling means comprises:

a pressure cylinder;

a piston arranged for reciprocating movement in said pressure cylinder;

an actuation member operatively connected with said piston;

a control element for controlling the pressure of a fluid medium present in said pressure cylinder;

said actuation member being operatively connected with said pivotable roll;

a reservoir for the fluid medium;

a control valve controlled by said control element and incorporated between said pressure cylinder and said reservoir for said fluid medium; and said control element being operatively connected with said displaceable roll.

4. The apparatus as defined in claim 2, wherein:

said mounting means supports one of both rolls to be both pivotable and displaceable.

5. The apparatus as defined in claim 2, wherein:

said bearing means comprises a rotation bearing;

said mounting means comprising a support member and guide means;

said support member being slideable in said guide means; and said control element being coupled by means of said rotation bearing and said support member slideable in said guide means with the displaceable roll.

6. The apparatus as defined in claim 2, further including:

a pivotal arm rotatably connecting the control element with a fixed part of the winding apparatus.

7. The apparatus as defined in claim 2, further including:

a rotatable and eccentrically supported rotating element connected with one end of said control element and pivotable in conjunction therewith;

said rotatable and eccentrically supported rotating element being disposed at said coupling location; and said actuation member being operatively coupled with said rotatable and eccentrically supported rotating element.

8. The apparatus as defined in claim 2, further including:

control cam means mounted on a fixed part of said winding apparatus; and said control cam means coacting with the control element for actuating said control element.

9. The apparatus as defined in claim 8, wherein:

said control cam means is detachably mounted at said fixed part of the winding apparatus.

10. The apparatus as defined in claim 8, wherein:

said control cam means is moveably mounted with respect to said fixed part of the winding apparatus.

11. The apparatus as defined in claim 4, wherein:

said mounting means comprises a support member and guide means;

said support member being slideable in said guide means;

said support member being fixedly connected with said coupling location; and said support member supporting said pivot axis and said one pivotable roll in a manner such that the actuation member causes pivotal movements of said one pivotable roll relative to said support member.

12. The apparatus as defined in claim 9, wherein:

said one pivotable roll comprises said bobbin support roll;

said mounting means including a rotation bearing provided for said bobbin support roll which is pivotably mounted on said pivot axis supporting the support member; and said actuation member being operatively connected with said rotation bearing.

* * * * *